US008931649B2

(12) United States Patent
Chen

(10) Patent No.: US 8,931,649 B2
(45) Date of Patent: Jan. 13, 2015

(54) RACK STRUCTURE FOR CUP OBJECTS

(71) Applicant: Fang-Yin Chen, Taichung (TW)

(72) Inventor: Fang-Yin Chen, Taichung (TW)

( * ) Notice: Subject to any disclaimer, the term of this patent is extended or adjusted under 35 U.S.C. 154(b) by 0 days.

(21) Appl. No.: 13/897,689

(22) Filed: May 20, 2013

(65) Prior Publication Data

US 2014/0311997 A1 Oct. 23, 2014

(30) Foreign Application Priority Data

Apr. 18, 2013 (TW) ..... 102207271 U

(51) Int. Cl.
*A47G 29/00* (2006.01)
*A47B 81/00* (2006.01)

(52) U.S. Cl.
CPC ..... *A47B 81/007* (2013.01)
USPC ..... 211/85.18; 211/85.31; 211/181.1

(58) Field of Classification Search
CPC ..... A47J 7/16; A47F 7/0064; A47F 7/0057; A47F 5/01; A47B 73/002; A47B 73/004; A47B 73/00; A47B 81/007
USPC ..... 211/71.01, 74, 85.18, 85.31, 181.1, 211/41.11, 41.1, 41.2, 41.3, 41.4; 248/107, 248/175; 294/141, 163
See application file for complete search history.

(56) References Cited

U.S. PATENT DOCUMENTS 439,569 A * 10/1890 Ahrens ..... 211/195
563,562 A * 7/1896 Burns ..... 211/71.01
588,440 A * 8/1897 Jones ..... 126/369
601,753 A * 4/1898 Kaiser ..... 211/41.2
995,120 A * 6/1911 Cooper ..... 211/41.13
1,093,450 A * 4/1914 McLaughlin ..... 108/109
1,211,269 A * 1/1917 Abbott ..... 211/85
1,266,245 A * 5/1918 Fuhrmann ..... 211/41.11
1,379,379 A * 5/1921 Abrahmsen ..... 211/41.4
1,888,141 A * 11/1932 Orth ..... 211/41.2
2,286,831 A * 6/1942 Ressinger ..... 211/85.17
2,634,865 A * 4/1953 Geheb ..... 211/41.11
3,497,118 A * 2/1970 Najjar ..... 224/196
4,691,832 A * 9/1987 Steiger ..... 211/85.23
4,776,469 A * 10/1988 Geleziunas ..... 211/41.11
4,878,586 A * 11/1989 Bancroft et al. ..... 211/106
4,911,308 A * 3/1990 Nylund ..... 211/41.2
5,393,226 A * 2/1995 Groom ..... 432/258
D393,783 S * 4/1998 Goodman ..... D7/704
D404,980 S * 2/1999 Goodman ..... D7/704
D405,300 S * 2/1999 Regan ..... D6/473
6,095,584 A * 8/2000 Walsh et al. ..... 294/166
D526,168 S * 8/2006 Goodman et al. ..... D7/704
D529,348 S * 10/2006 Goodman et al. ..... D7/704
D538,609 S * 3/2007 Goodman et al. ..... D7/704
D539,104 S * 3/2007 Goodman et al. ..... D7/704

(Continued)

*Primary Examiner* — Jonathan Liu
*Assistant Examiner* — Stanton L Krycinski
(74) *Attorney, Agent, or Firm* — Raymond Y. Chan; David and Raymond Patent Firm

(57) ABSTRACT

The creation is a rack for cup objects, which provides a rack easy to use and capable of placing cup objects, including: an integrated bended form of two vertical rods providing with symmetrical, vertically separated aligned oblique projections, wherein the oblique projections are inclined to the two vertical rods with oblique angles, a space is formed between upper and lower oblique projections, the space may contain embedded cup objects, and the oblique projection may be used to jam the cup cover of the cup object such that the effect that the cup object is positioned, undetached, and thus multiple cup objects may be positioned in alignment and easy to access is achieved.

6 Claims, 3 Drawing Sheets

(56) References Cited

U.S. PATENT DOCUMENTS

| | | | | | |
|---|---|---|---|---|---|
| D547,621 | S | * | 7/2007 | Ku et al. | D7/704 |
| 7,520,397 | B1 | * | 4/2009 | Segale | 211/106 |
| D610,385 | S | * | 2/2010 | Chen | D7/619.1 |
| D625,534 | S | * | 10/2010 | Chen | D7/619.1 |
| D628,865 | S | * | 12/2010 | Guindi | D7/704 |
| D630,869 | S | * | 1/2011 | Evans | D6/462 |
| D630,903 | S | * | 1/2011 | Chen | D7/619.1 |
| D632,136 | S | * | 2/2011 | Chen | D7/600.1 |
| D632,137 | S | * | 2/2011 | Chen | D7/619.1 |
| D652,697 | S | * | 1/2012 | Guindi | D7/704 |
| 8,844,733 | B2 | * | 9/2014 | Waksul | 211/41.2 |

* cited by examiner

RACK STRUCTURE FOR CUP OBJECTS

FIELD OF THE INVENTION

The creation is a rack for cup objects such that the rack is provided for placing multiple cup objects in alignment vertically for each to access the cup objects.

DESCRIPTION OF THE PRIOR ART

Small cup shaped package are used for cream, cream ball and coffee. For conventional method for placing cup object, "bag", "box" and "case" are used. Specifically, multiple cup objects are placed in a "bag" or "box". There are the following problems: (1) multiple messy placements will cause untidiness and non-beauty, and mutual collision and extrusion that will result in recession, deformation or breaking; (2) the access is always from the top layer and the replenishment is also at the top location such that the lower layer cannot be accessed that results in overdue situation; (3) it is inconvenient in use because the closed bag or box has to be opened for access every time.

SUMMARY OF THE INVENTION

The creation is used to improve the above shortages. The major technologies and purposes are: setting an integrated form with two vertical rods providing with multiple vertically symmetrical oblique projections, with each oblique projection inclined to the two vertical rods with oblique angles, wherein a space is formed between the upper and lower oblique projections with cp objects contained in the space, a cup cover may be retained at the oblique projection such that multiple cup objects may be positioned vertically in alignment to achieve the effect of ease to access and alignment without extrusion.

DETAILED DESCRIPTION OF THE PREFERRED EMBODIMENTS

Figure 1:
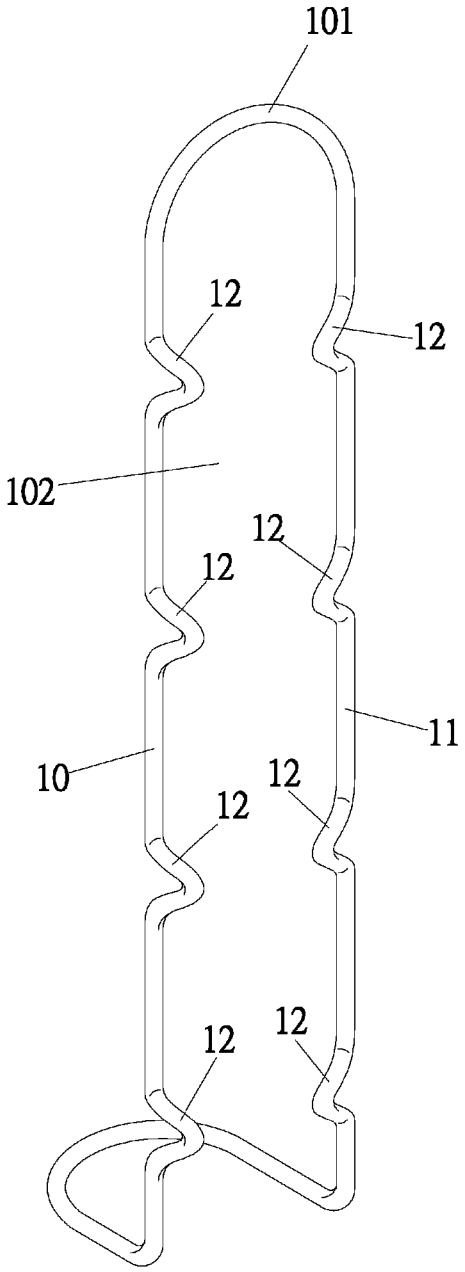
FIG. 1 is a perspective view of the creation.
Figure 2:
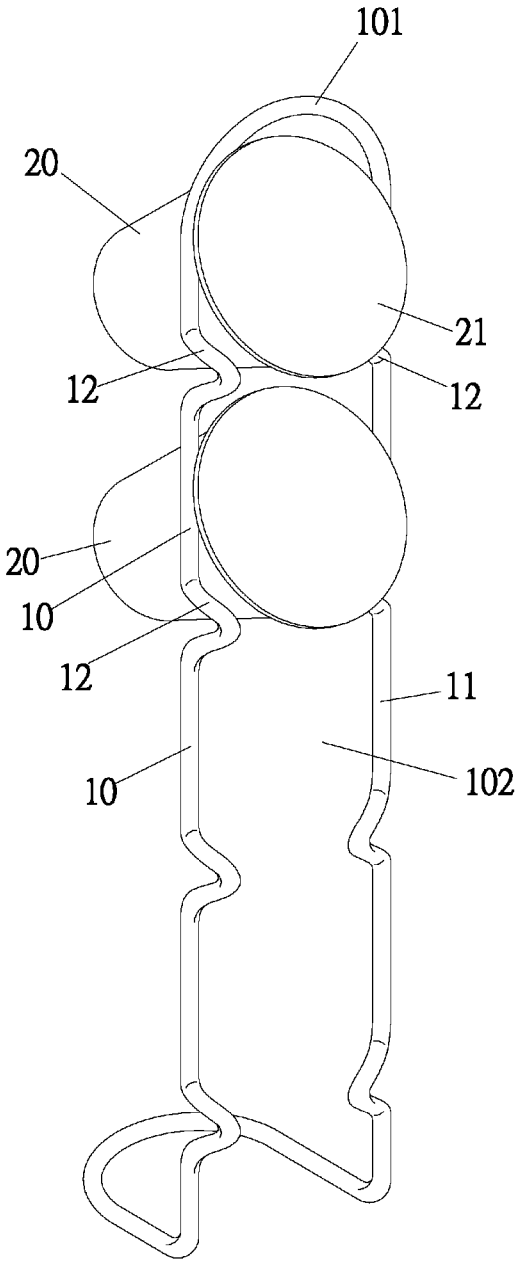
FIG. 2 is a perspective view of the creation in use state.
Figure 3:
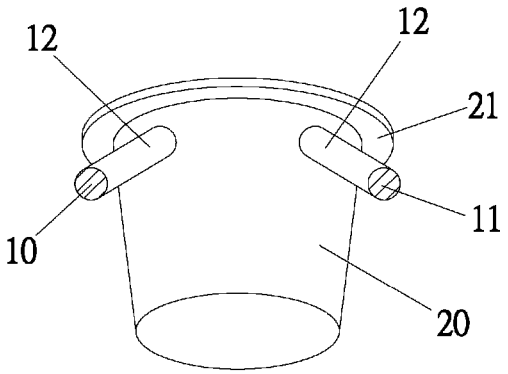
FIG. 3 is a top cross-sectional view of the creation in use state.

Refer to FIGS. 1, 2 and 3, two vertical rods 10, 11 are provided with multiple symmetrical projections 12 aligned vertically in separation. Each projection 12 is inclined between the two vertical rods 10, 11 with an oblique angle. A space 102 is formed between the upper and lower projections 12 of the two vertical rods 10, 11. A cup object 20 is contained in the space 102. Further, the tops of the two vertical rods 10, 11 are provided with a connection segment 101 for connection as an entity 101.

According to the above structure, the following effects and advantages may be achieved.

(1) As shown in FIGS. 2 and 3, the cup object 20 is embedded into the space 102 of the two vertical rods 10, 11. Because the two vertical rods 10, 11 are provided with a oblique projection 12, and the oblique projection 12 is inclined between the two vertical rods 10,11 with an oblique angle, the effect that the oblique projection 12 supports the cup object 20 is achieved, and the cup cover 21 of the cup object 20 may jam at the two vertical rods 10, 11, oblique projection 12 such that the cup object 20 is not detached for multiple cup objects 20 to be positioned vertically in alignment with the effect of easy access to cup objects and easy to use.

(2) A connection segment 101 is arranged at the tops of the two vertical rods 10, 11 for portability and easy to move positions in alignment together.

Figure 4:
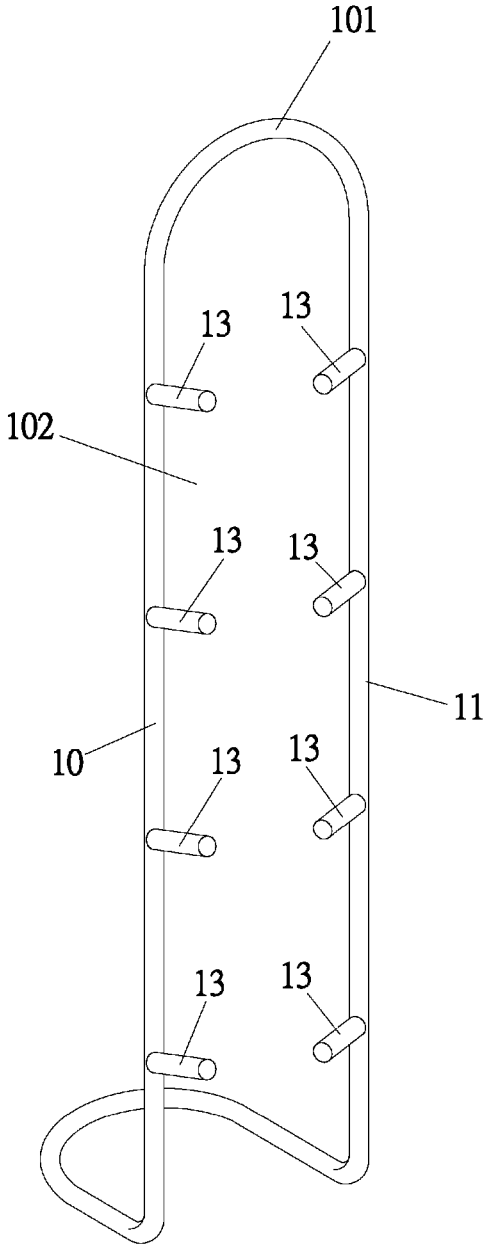
FIG. 4 is a perspective view of another example of the creation.
Figure 5:
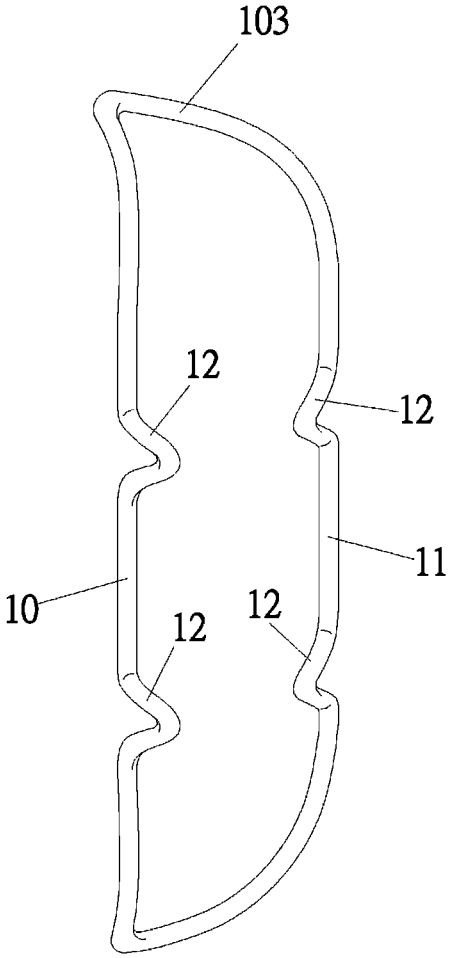
FIG. 5 is a perspective view of another example of the creation.

In addition, according to the technical means described above, the creation may also be embodied in form as shown in FIG. 4 by configuring the oblique projections of the two vertical rods 10, 11 as a rod shaped oblique tappet 13 to achieve the effect of mounting cup objects 20. Another example is presented in the form as shown in FIG. 5, in which the tops of the two vertical rods 10, 11 are provided with a slightly arc connection segment 103. It also belongs to the equivalent structure innovation scope of the creation.

In summary, the structure of the creation does have excellent practicability and improve the effect, and does be compliant with the principle of new model patent. It is appreciated to be certified with patent.

What is claimed is:

1. A rack for a cup object having a cup cover, comprising: two spaced apart vertical rods extended parallelly; and a plurality of oblique projections extended inclinedly from said vertical rods with an oblique angle and aligned symmetrically between said two vertical rods, wherein said oblique projections at each of said vertical rods define at least an upper projection and at least a lower projection positioned below said upper projection along each of said vertical rods, wherein said oblique projections, which are symmetrically aligned at said two vertical rods, are inclined between said two vertical rods so as to extend toward each other, wherein a space is formed between said two vertical rods and between said upper and lower projections of each of said vertical rods, wherein said space is big enough for said cup object passing therethrough while said cup cover is jammed at said vertical rods and said upper and lower projections.

2. The rack, as recited in claim 1, wherein each of said vertical rods is bent to integrally form said oblique projections at each of said vertical rods in a vertically separated and aligned manner.

3. The rack, as recited in claim 1, wherein said oblique projections are a plurality of oblique tappets extended inclinedly from said vertical rods with said oblique angle.

4. The rack, as recited in claim 2, further comprising a connection segment extended from tops of said vertical rods to form an entity, wherein said rack is formed from an integral rod.

5. The rack, as recited in claim 3, further comprising a connection segment extended from tops of said vertical rods to form an entity.

6. The rack, as recited in claim 2, further comprising an arc-shaped connection segment extended from tops of said vertical rods to form an entity, wherein said rack is formed from an integral rod.

* * * * *